US005971190A

United States Patent [19]

Mannino

[11] Patent Number: 5,971,190

[45] Date of Patent: Oct. 26, 1999

[54] SPLIT RING CLOSURE FOR CYLINDRICAL DRUM

[76] Inventor: Anthony Mannino, 1-S.-492 Chase St., Lombard, Ill. 60148

[21] Appl. No.: 09/014,920

[22] Filed: Jan. 28, 1998

[51] Int. Cl.[6] ..... B65D 45/32

[52] U.S. Cl. ..... 220/320; 24/68 C; 215/274; 215/280; 215/283; 220/319; 292/256.67

[58] Field of Search ..... 220/320, 319, 220/315; 215/273–276, 279–280, 283; 292/256.6, 256.67, 299; 24/37, 68 C

[56] References Cited

U.S. PATENT DOCUMENTS

| | | | |
|---|---|---|---|
| 398,633 | 2/1889 | Legan | 215/280 |
| 407,559 | 7/1889 | Wells | 292/256.67 |
| 1,137,085 | 4/1915 | Riddle | 220/320 |
| 1,197,924 | 9/1916 | Ellinger | 220/320 |
| 2,226,396 | 12/1940 | Wackman | 24/68 C |
| 2,603,382 | 7/1952 | Kojan | 24/68 C |
| 2,633,616 | 4/1953 | Kohout | 292/256.67 |
| 2,715,477 | 8/1955 | North | 220/320 |
| 2,915,330 | 12/1959 | Verbiar | 220/320 |
| 3,077,360 | 2/1963 | Israel | 292/256.67 |
| 3,346,139 | 10/1967 | Armstrong, Jr. | 220/320 |
| 3,447,825 | 6/1969 | Santoni | 220/320 |
| 4,253,583 | 3/1981 | Lynch | 215/274 |
| 4,646,931 | 3/1987 | Andrews et al. | 220/319 |
| 4,741,453 | 5/1988 | Stolzman | 220/320 |
| 4,982,864 | 1/1991 | Kusta | 220/320 |
| 5,193,864 | 3/1993 | Coleman | 220/320 |
| 5,215,206 | 6/1993 | Siblik | 220/320 |
| 5,584,410 | 12/1996 | Siblik | 220/320 |
| 5,829,624 | 11/1998 | Skolnik et al. | 220/320 |
| 5,851,038 | 12/1998 | Robinson et al. | 292/256.67 |

*Primary Examiner*—Allan N. Shoap
*Assistant Examiner*—Robin A. Hylton
*Attorney, Agent, or Firm*—Marshall, O'Toole, Gerstein, Murray & Borun

[57] ABSTRACT

Closure means for fastening a cover over the open end of a cylindrical drum, utilizing an annular split ring contoured to mate the cover to the drum. Included are a pair of depending lugs, extending from the ring on opposite sides of the split. Each of the lugs has a substantially parallel lateral face and a transverse opening therethrough. Spacer means are provided between the lugs. A tie bolt mounted through the openings of the lugs is tightened so the lugs are drawn together, contracting the ring. The spacer means between the lugs form a pivot point with the lugs, drawing the ring in a direction toward the pivot point.

13 Claims, 1 Drawing Sheet

SPLIT RING CLOSURE FOR CYLINDRICAL DRUM

BACKGROUND OF THE INVENTION

1. Field of the Invention

This invention relates to closure assemblies for securing associated lids or covers over the open heads of cylindrical storage drums, and more particularly to improvements in lugs associated with split metal closure rings as utilized for securing lids to drums.

2. Background Art

A search of the records of the U.S. Patent Office directed to the subject matter of this application discovered the following U.S. Pat. Nos.:

3,346,139
3,447,825
4,129,151
4,219,125
4,741,453
4,890,756
4,982,864
5,201,437
5,215,206
5,584,410

A review of the above patents determined that none of the patents disclosed or claimed a closure arrangement including lugs and spacer means as taught within the present application.

Storage drums as utilized in connection with the present invention are frequently employed because of their reusability. The drums typically have a semi-cylindrical bead rim about their upper ends and an associated lid has a mating peripheral lip which fits over the drum bead and, in many instances, a gasket seal is included therebetween. Typically, metal closure rings are mounted over the lids, lip and the drum bead and then compressed to bring the ends of the ring together in an abutting relationship to secure the lid in place. This arrangement typically provides a seal between the drum and the lid.

The problem typically facing the industry is leakage of liquid under pressure at the opening where the split ring is joined together and at the bolt utilized for securing the lugs on either side of the split. Such leakage is caused by tightening of the ring. Another problem is the damage and leakage at the ring when a so-called drop test is performed. Most corrective attempts made so far have been by changing the gasket materials as well as shape of the ring. The lugs and clips used throughout the industry are made and welded in such a way that cause the ring to twist as the bolt is tightened, raising the lip of the ring in the area of the lugs and clips. This fault typically occurs because the tightening occurs below the center line of the ring. The lugs of the present invention are designed to provide a lever action between a projecting area on each lug and the bolt head to force the ring down in the area of the ring opening.

SUMMARY OF THE INVENTION

The present invention is drawn to a split ring closure, with a pair of lugs mounted on either side of the split extending outwardly and downward of the ring. Each of the lugs includes a projection extending in a direction towards the opposing lug and assists in providing a pivot point to ensure the proper mating and positioning of the split ring on the drum and with an included cover.

As indicated, an annular split metal closure ring positioned over the lids lip and drum bead and then is compressed to bring the ends of the ring together to secure the lid in place. This effects the seal between the drum and lid.

Typically, the pair of lugs utilized are welded to the ring on either side of the split therein so that they extend outwardly and downwardly on the ring, the mounted lugs or clamps have coaxially aligned openings for passage of a tie bolt therethrough. Once the tie bolt has been positioned through the lugs, a nut is secured to the opposite end and the bolt is drawn tight to effectively compress the ring to effect the sealed connection between the lid and the drum.

Accordingly, it is the object of the present invention to provide a split ring for use in sealing lids to cylindrical drums that reduces or eliminates twisting of the ends of the ring as the bolt tightens the ring.

This effectively occurs as the bolt tightens the ring. A spacer or projecting areas on each of the lugs make contact creating a simple lever between the projected areas and the head of the bolt and nut, which are approximately 180° from the contact area of the projections. This will force the ring down towards the cover, ensuring a more secure relationship between the lid and drum. The lugs as attached to either side of the opening of the split ring are simple in construction and economical to produce. Projections on each of the lugs face in an inward direction toward the split of the ring and toward each other during the tightening process. Each projection may be formed by swaging a portion of the metal so it projects the short distance necessary to provide that pivot point between the two lugs. Projection may be added to the lugs by means of welding, braising, or similar techniques. Other ways of forming the projections may be to cast the lugs with the included projections or any other of several well-known techniques. The openings are such that a tie bolt readily passes through both lugs without particular centering means and a nut is secured to a far end of the tie bolt whereby the tie bolt and nut combination may be utilized to pull the two ends of the split ring together with the spacer or projecting points on each of the lugs mating with each other when tie bolt is drawn up to its most secure position.

The present arrangement is effected to prevent undesirable radial and circumferential movement and resulting distortion of the split ring leading to consequent failure of the seal between the drum and its associated cover. This is particularly true in the case of heavy or severe impact forces on the split ring or closure assembly. Radial movement of the ring is likely to occur if sufficient impact forces occur adjacent to either of the lugs which can cause the bolt to move radially within the openings of the lugs. Impact occurring on either of the lugs when the ring is closed can cause distortion of the ring and also cause momentary circumferential movement of the lugs relative to the tie bolt. This, too, may result in either or both radial or circumferential movement of the split ring.

BRIEF DESCRIPTION OF THE DRAWINGS

A better understanding of the present invention may be had from consideration of the following detailed description taken in conjunction with the following drawings wherein similar numbers denote similar elements.

DETAILED DESCRIPTION OF THE PREFERRED EMBODIMENTS

Figure 1:
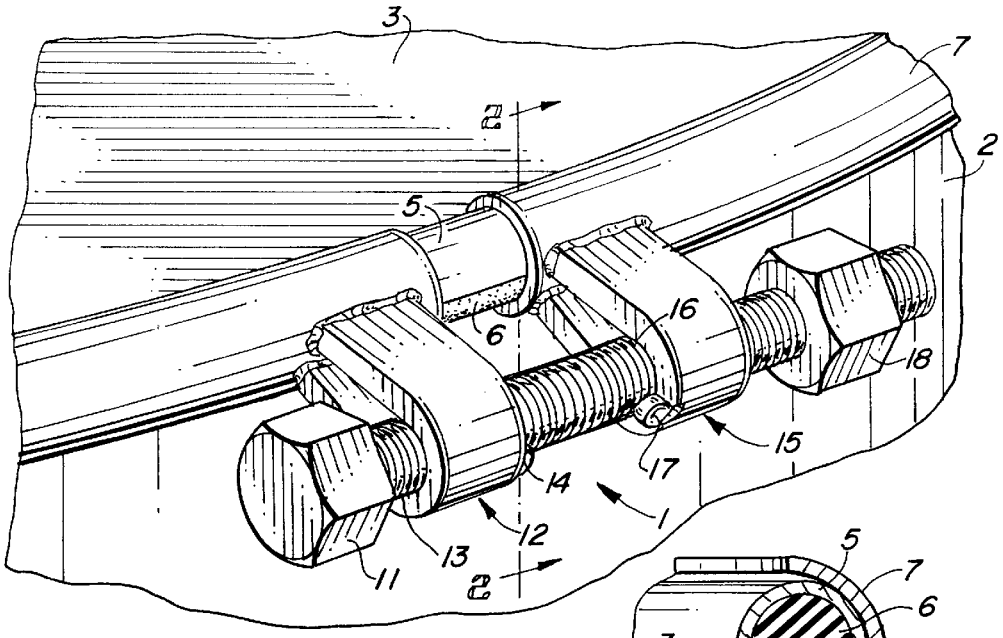
FIG. 1 is a fragmentary perspective view of a drum and lid with a closure in accordance with the teaching of the present invention.

Referring now to FIG. 1 of the drawings, it will be seen that a closure ring assembly 1 is mountable over the open end of a storage drum 2 which is covered by a cover or lid 3. The drum as can be seen in FIG. 2 has a bead rim formed about its upper end, assembly 1 serves to lock cover 3 onto the drums bead rim while compressing sealing gasket 6 between that rim and the covers lip 5.

Figure 2:
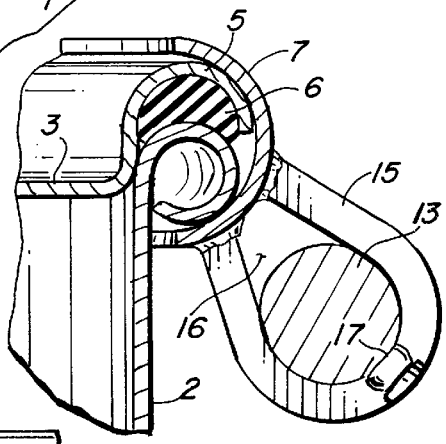
FIG. 2 is a partial sectional view of a drum and cover in accordance with the teachings of the present invention showing a portion of a closure as taught by the present invention secured thereto.
Figure 3:
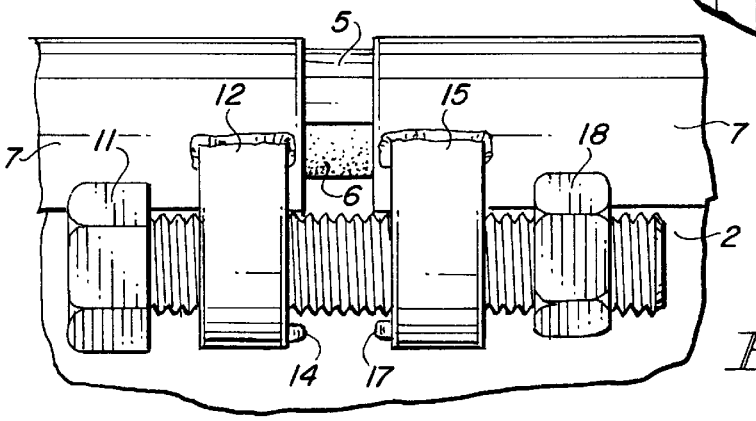
FIG. 3 is a partial side elevation view of a closure and cover in accordance with the terms of the present invention prior to tightening of the tie bolt through the lugs contained on the closure.
Figure 4:
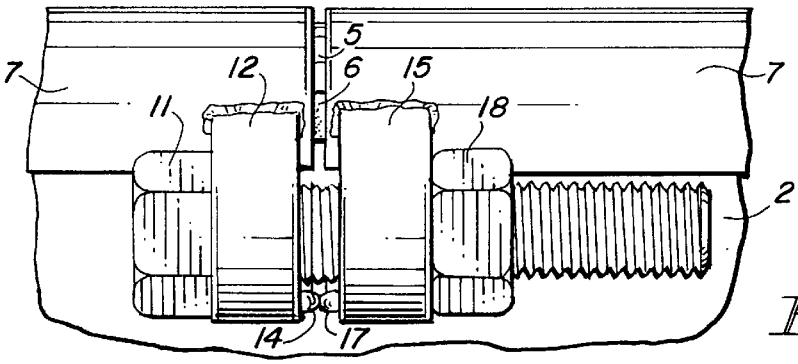
FIG. 4 is a partial side elevation view showing the closure of the present invention in its tightened form with the projections on the lugs mating to provide a pivot point to secure proper relationship of the split ends of the ring as utilized in the closure of the present invention.

The closure 1 consists of annular split ring 7 with a semi-circular transverse cross-section as seen in FIG. 2 and includes a pair of rigid locking lugs 12 and 15. These lugs are affixed to the ring in positions parallel to each other separated by the split of the ring as can be seen in FIG. 1. The two lugs extend generally outwardly and slightly downward as can be seen in both FIGS. 1 and 2. Closure of the ring, as can be seen in FIGS. 1 and 3 is secured by means of tie bolt 11 which extends through both lugs 12 and 15 and has secured on its distal end nut 18. When the bolt is tightened, the ends of the split ring 7 are drawn together until such time as projections 14 and 16 (each approximately 1/16") occurring on lugs 12 and 15, respectively engage each other and mate. This action, and the mating of projections 14 and 16, causes a pivot point to be formed at their joinder acting to create a lever between the projections or pivot point and the bolt. Alternatively, a single projection (approximately 1/8") on only one lug could be employed, enjoining the lateral surface of the other lug. This operation tends to force the ring down towards the cover in the area.

It will be understood that initially the drum lid 3 is placed upon drum 2 and the closing ring 7 is then applied over and around bead at top of the drum and the lip 5 of lid 3. It is also noted that a gasket 6 may be located between the beaded top of drum 2 and the lip 5 of lid 3. At this point, the ring is tightened by means of tie bolt 11 which is extended through the openings 13 and 17 of lugs 12 and 15, respectively. Nut 18 is applied to the distal end of tie bolt 11 and after which tie bolt 11 may be tightened. When this occurs, both an inward radial and downward vertical force is applied to the ring 7 to the bead and lip and any gasket that may be contained therebetween. The present arrangement, particularly with the projections 14 and 16 on lugs 12 and 15, is effective to prevent radial and circumferential movement and distortion of the split ring leading to failure of the seal between the drum and the lid.

In an alternate embodiment of the present invention it has been found possible to substitute for the projections on lugs 12 and 15 placement of a small washer of conventional configuration around the tie bolt positioned between lugs 12 and 15. The small washer of conventional design, having a diameter only slightly larger than that of the tie bolt, and having a thickness approximately the same thickness as the projections 14 and 16 extending from lugs 12 and 15, respectively, will work in a similar manner as the two projections acting as a pivot point when the tie bolt is tightened between lugs 12 and 15, drawing the split ring together and downward toward the separating means in the form of a washer or as the same way as drawn towards the lower end of the lugs when the projections 14 and 16 are included thereon.

While but a few embodiments of the present invention have been shown, it will be obvious to those skilled in the art that numerous modifications may be made without departing from the spirit of the present invention, which shall be limited only by the scope of the claims appended hereto.

What is claimed is:

1. Closure means for fastening a cover including an annular lip on the periphery thereof, over an annular bead rim located above circumferentially around the open end of a cylindrical drum, said closure means comprising:

an annular split ring contoured to mate with said lip and said bead;

a pair of laterally spaced first and second depending lugs, extending outwardly from said ring on opposite sides of said split;

each of said lugs having substantially parallel lateral faces and a transverse opening therethrough;

a spacer extending from the lateral face of at least one of said lugs in a direction toward the other one of said lugs;

a tie bolt having a threaded portion mounted through the openings of said lugs to extend therebetween;

whereby in response to the tightening of said bolt, said lugs are drawn together contracting said ring, said spacer between said first and second lugs drawn together forming a pivot point, drawing said ring in a direction toward said pivot point.

2. Closure means as claimed in claim 1 wherein:

said ring is metal and a portion of each of said lugs is welded in connection to said ring.

3. Closure means as claimed in claim 1 wherein:

said spacer comprises a projection extending from the lateral face of both of said lugs in a direction toward the other one of said lugs.

4. Closure means as claimed in claim 3 wherein:

said projections are positioned on said lugs in a location farthest from said ring.

5. Closure means as claimed in claim 3 wherein:

said projections are swaged from said lugs.

6. Closure means as claimed in claim 3 wherein:

said projections are welded to said lugs.

7. Closure means as claimed in claim 3 wherein:

said projections are molded with said lugs.

8. Closure means as claimed in claim 3 wherein:

said projections are machined from the surface of said lugs.

9. Closure means as claimed in claim 1 wherein:

said lugs project angularly away from said ring.

10. Closure means as claimed in claim 1 wherein:

there is further included a gasket between said annular lip and said annular bead.

11. Closure means as claimed in claim 10 wherein:

said split ring contracts said gasket between said lip and said annular bead.

12. Closure means for a drum having an annular modular bead at its mouth, said bead being arcuate in cross-section, a drum closure lid for the mouth of the drum having a marginally continuous annular flange arcuate in cross-section and downwardly concave so as to fit over said bead, said flange cross-sectional arc extending substantially over said bead, said closure means comprising:

an exterior split clamping ring engaging said closure lid and said drum bead firmly securing said lid to said drum;

a pair of laterally spaced depending lugs extending outwardly from said ring on opposite sides of said split;

each of said lugs having substantially parallel lateral faces and an opening therethrough;

spacer means extending from the lateral face of at least one of said lugs in a direction toward the other one of said lugs;

tightening means mounted through the opening of said lugs;

wherein in response to the operation of said tightening means said lugs are drawn together contracting said ring and said lugs are drawn towards each other whereby contact is made with said spacer means forming a pivot point; and said ring is drawn in a direction toward said pivot point.

13. Closure means as claimed in claim 12 wherein:

said spacer means comprises a projection extending from the lateral face of both of said lugs in a direction toward the other one of said lugs.

* * * * *